US008033773B2

(12) United States Patent
Zangerle

(10) Patent No.: US 8,033,773 B2
(45) Date of Patent: Oct. 11, 2011

(54) PARKING FACILITY FOR MOTOR VEHICLES AND METHOD OF OPERATING SAME

(75) Inventor: Andreas Zangerle, Renningen (DE)

(73) Assignee: WAP Woehr Automatikparksysteme GmbH & Co KG, Korntal-Muenchingen (DE)

( * ) Notice: Subject to any disclaimer, the term of this patent is extended or adjusted under 35 U.S.C. 154(b) by 124 days.

(21) Appl. No.: 12/462,779

(22) Filed: Aug. 6, 2009

(65) Prior Publication Data

US 2010/0017016 A1 Jan. 21, 2010

Related U.S. Application Data

(63) Continuation of application No. PCT/EP2007/001220, filed on Feb. 13, 2007.

(51) Int. Cl.
*E04H 6/12* (2006.01)

(52) U.S. Cl. ..... 414/258; 414/236; 414/239; 414/246; 414/264; 414/807

(58) Field of Classification Search ..... 414/236, 414/239, 246, 258, 264, 807
See application file for complete search history.

(56) References Cited

U.S. PATENT DOCUMENTS

| | | | | |
|---|---|---|---|---|
| 1,554,584 | A * | 9/1925 | Lake | 414/246 |
| 1,804,338 | A * | 5/1931 | Henderson | 414/228 |
| 2,061,420 | A * | 11/1936 | Ferris | 414/247 |
| 2,754,014 | A * | 7/1956 | Santochi | 414/258 |
| 2,785,809 | A * | 3/1957 | Riblet | 414/246 |
| 2,856,081 | A * | 10/1958 | Zaha | 414/251 |
| 2,915,203 | A * | 12/1959 | Kurmer | 414/229 |
| 3,125,235 | A * | 3/1964 | Frangos | 414/239 |
| 4,936,730 | A * | 6/1990 | Morioka | 414/239 |
| 5,066,187 | A * | 11/1991 | Hammer | 414/237 |
| 5,383,757 | A * | 1/1995 | Takaoka et al. | 414/240 |
| 5,961,270 | A * | 10/1999 | Ortega et al. | 414/234 |

FOREIGN PATENT DOCUMENTS

| | | |
|---|---|---|
| CH | 446 687 | 11/1967 |
| DE | 40 32 529 | 4/1992 |
| DE | 43 38 121 | 5/1995 |
| DE | 200 11 495 | 2/2001 |
| EP | 0 432 129 | 6/1991 |
| EP | 0 501 935 | 9/1992 |
| EP | 0 952 280 | 10/1999 |
| WO | 89/01557 | 2/1989 |
| WO | 89/04900 | 6/1989 |

* cited by examiner

*Primary Examiner* — Scott Lowe
(74) *Attorney, Agent, or Firm* — Lipsitz & McAllister, LLC

(57) ABSTRACT

A parking facility for motor vehicles having fixed parking places arranged above each other and each having a guide for a pallet that is displaceable along the guide as well as a lift, which is disposed alongside the fixed parking places and which also carries a guide for the pallet is provided. For displacement of the pallet between the respective guides of a parking place and the lift, the lift is stopped alongside a parking place such that the respective guides are aligned with one another. The guide of the lift at its end facing the parking place is supported on a supporting surface connected to the parking place. The guide of the lift after being set down onto the supporting surface is pivoted about a horizontal pivotal axis until the guide of the lift is in a horizontal position.

32 Claims, 17 Drawing Sheets

PARKING FACILITY FOR MOTOR VEHICLES AND METHOD OF OPERATING SAME

This application is a continuation of international application number PCT/EP2007/001220 filed on Feb. 13, 2007.

The present disclosure relates to the subject matter disclosed in international application PCT/EP2007/001220 of Feb. 13, 2007, which is incorporated herein by reference in its entirety and for all purposes.

BACKGROUND OF THE INVENTION

The invention relates to a method of operating a parking facility for motor vehicles that comprises fixed parking places arranged above each other and each having a guide for a pallet that is displaceable along the guide as well as a lift, which is disposed alongside the fixed parking places and also carries a guide for a pallet displaceable therein, in which method for displacement of a pallet between the guide of a fixed parking place and the guide of the lift the lift is stopped in such a way alongside a fixed parking place that the guides of the fixed parking place and of the lift are aligned with one another, wherein the guide of the lift at its end facing the fixed parking place is supported on a supporting surface connected to the fixed parking place.

In such parking facilities motor vehicles are moved in an entry station onto a pallet, and this pallet together with the motor vehicle positioned thereon is displaced into the lift, which then firstly lifts or lowers and secondly optionally also additionally laterally displaces the pallet with the motor vehicle so that the pallet disposed on the lift may be positioned opposite a fixed parking place, into which the pallet together with the motor vehicle positioned thereon is to be pushed.

In this way each parking place of the rack-like parking place arrangement may be reached so that the pallet carrying the motor vehicle can, after alignment with the parking place, be pushed with the motor vehicle into the parking place.

A problem here is reliable alignment of the guide for the pallet on the lift, on the one hand, and the guide for the pallet in the fixed parking place, on the other hand. Admittedly, this alignment may be improved by placing the end of the guide of the lift facing the parking place onto a supporting surface connected in a fixed manner to the parking place but then problems arise if the lift does not exactly reach the necessary height alongside a parking place to be approached. Such inaccuracies of the positioning of the lift may readily occur, firstly as a result of different loading of the lift with various motor vehicles and secondly also as a result of the high lifting speeds, that are conventionally used to reduce the conveying times, and/or wear phenomena of the lift.

The object of the invention is to develop a method of the described type in such a way that the guide of the lift may easily be aligned precisely with the guide of the parking place to be approached.

SUMMARY OF THE INVENTION

In a method of the initially described type, this object is achieved according to the invention in that the guide of the lift after being set down onto the supporting surface is pivoted about a horizontal parking-place-side pivotal axis, which extends transversely of the displacement direction and is defined by the support point of the guide of the lift on the supporting surface, until the guide of the lift is in a horizontal position.

The setting-down of the guide of the lift onto the supporting surface gives rise to a pivot bearing arrangement, i.e. the guide may be pivoted on the supporting surface about a horizontal pivotal axis, so that by means of such a pivotal movement a guide on the lift may also be positioned precisely horizontally if it itself during setting down or during the subsequent stopping of the lift is not in a precisely horizontal position and hence is not precisely aligned with the guide of the parking place.

In this case, it is advantageous if the guide is pivoted about the parking-place-side pivotal axis in that the guide of the lift, which is mounted on the lift so as to be pivotable about an axis of inclination extending parallel to the parking-place-side pivotal axis, is raised or lowered by means of an upward or downward movement of the lift. The guide is therefore mounted on the lift so as to be likewise pivotable about an axis of inclination that extends parallel to the parking-place-side pivotal axis, and so by simply raising and lowering the lift the guide of the lift may be pivoted in such a way that it is finally in a precisely horizontal position, even if this should not the case during the initial rapid travel of the lift up to the parking place to be approached.

While this corrective pivotal movement of the guide of the lift is achieved preferably by means of a lifting movement of the lift, according to a modified development of the invention it may also be provided that this pivotal movement of the guide on the lift into the horizontal is effected by means of a lifting device disposed on the lift, for example by means of a hydraulic cylinder or an electric drive.

It is particularly advantageous if according to a preferred embodiment the guide of the lift prior to setting down on the supporting surface of a parking place is pivoted relative to the lift down towards the parking place about an axis of inclination extending parallel to the parking-place-side pivotal axis and after setting down is pivoted into the horizontal position. Thus, the guide on the lift shortly before being set down onto the supporting surface on the parking place to be approached is inclined down towards the parking place and only after being set down onto the supporting surface, either by means of a further movement of the lift or by means of a lifting movement of a lifting device disposed on the lift, is pivoted into the horizontal. This pivotal movement may be made dependent upon the holding position, in which the lift has been stopped opposite the parking place to be approached, and independently of this actual holding position the horizontal position for the guide may be achieved by means of a simple pivotal movement of this guide on the lift.

In a preferred embodiment of the invention it is provided that the guide of the lift for setting down onto a supporting surface of a parking place to be approached is displaced in displacement direction of the guide horizontally out of a lifting position, in which the guide during travel of the lift between various parking places is situated in such a way that it is spaced apart from the supporting surfaces of the parking places, into a set-down position, in which the ends of the guide of the lift are situated above the supporting surface of the parking place to be approached. This ensures that the lift together with the guide disposed on the lift may, during its raising and lowering and optionally also during a transverse displacement, move without difficulty past all of the parking places and the supporting surfaces projecting therefrom. It is only during lowering and shortly before reaching the parking place to be approached that the guide on the lift is displaced far enough in horizontal direction for it to be disposed with its end above the supporting surface of the parking place to be approached and may upon further lowering be set down onto this supporting surface.

In this case, it is particularly advantageous if by means of the horizontal displacement of the guide on the lift out of the lifting position into the set-down position by a suitable gearing mechanism the guide of the lift is simultaneously pivoted about the axis of inclination in such a way that its end facing the parking place to be approached is lowered relative to the opposite end. Thus, there is no need for a separate drive to effect the pivotal movement of the guide on the lift prior to setting down onto the supporting surface, rather the movement, which the guide experiences in any case as a result of the horizontal displacement and which leads by means of a gearing mechanism to a pivotal movement that lowers the guide in the direction of the parking place, is utilized.

For example, it may be provided that the guide of the lift during the horizontal displacement is guided along a track, which dips at the end facing the parking place to be approached and/or rises at the end remote from the parking place to be approached.

In a first development of the method according to the invention it is provided that the axis of inclination of the guides of the lift is disposed centrally in the longitudinal direction of the guides. This results in relatively simple kinematics, the end of the guide on the other hand in this case being only half the guide length away from this axis of inclination so that upon a pivotal movement of the guide a relatively large displacement in horizontal direction is effected, i.e. upon a pivotal movement the distance of the end of the guide on the lift from the guide in the parking place to be approached varies, the occurrence of relatively large gaps being possible.

To avoid this, according to a further preferred embodiment the axis of inclination of the guide of the lift may be disposed at the side of the guide of the lift remote from the parking place to be approached, thereby increasing the distance between the axis of inclination of the guide, on the one hand, and the supporting surfaces of the parking place, on the other hand.

The parking facility may be of a symmetrical construction, i.e. parking places of the same construction may be disposed at opposite sides of the lift and the guide of the same construction at its opposite sides may be aligned selectively with a parking place to be approached at the one or the opposite side.

Another embodiment provides that parking places of the same construction are disposed at opposite sides of the lift and that the guide on the lift rotates about a vertical axis of rotation in order to align the guide of the lift with the guide of a parking place to be approached. Such a rotatability of the guide of the lift about the vertical axis may also be useful for connecting the guide of the lift to an entry station and/or an exit station.

The above methods are particularly suitable for parking facilities where in the guides of the lift, of the parking places and optionally of an entry station of the parking facility, in which a motor vehicle is driven onto a pallet, and/or of an exit station, in which a motor vehicle positioned on a pallet leaves the pallet, in a respective pair of guideways arranged above each other, upon each displacement of a pallet between lift and approached parking place or entry- or exit station in the top guideway, a pallet in the bottom guideway is displaced in the opposite direction, so that before and after the displacement of the pallets there is always one pallet in the guide of the lift and one pallet in the approached parking place as well as in the entry station and the exit station. Such a procedure speeds up the pallet change because it is ensured that at any time at each parking place, in the lift, in the entry station and in the exit station an unoccupied pallet is available, which may be exchanged for a pallet that is usable or in use. This speeds up the pallet change both in the region between lift and parking place as well as in the region between lift and entry station as well as exit station.

It may further be provided that in the exit station the pallet is lowered from the top guideway into the bottom guideway after the motor vehicle has left the top pallet.

It may further be provided that in the entry station a pallet is lifted from the bottom guideway into the top guideway before a motor vehicle drives into the entry station onto a top pallet.

The invention further relates to a parking facility for motor vehicles having fixed parking places, which are disposed alongside one another and each have a guide for a pallet that is displaceable along the guide, and having a lift, which is disposed alongside the fixed parking places and likewise has a guide for a pallet that is displaceable along said guide, having a supporting surface, which is connected to the fixed parking places and onto which the end of the guide of the lift facing a parking place to be approached can be set down in order to align the guides of the lift and of the parking place to be approached for displacement of a pallet between said guides, and having a control device for operating the lift and for displacing the pallets.

The object of the invention is to design a parking facility of the described type in such a way the aligning of the guides on the lift and in a parking place to be approached is improved.

In a parking facility of the initially described type, this object is achieved according to the invention in that the guide of the lift after being set down onto the supporting surface forms a horizontal, parking-place-side pivotal axis, which extends transversely of the displacement direction and is defined by the support point of the guide of the lift on the supporting surface, and that the control device by means of a drive pivots the guide of the lift after setting-down on the supporting surface about the parking-place-side pivotal axis until the guide of the lift is in a horizontal position.

In this case, it is advantageous if the guide of the lift is mounted on the lift so as to be pivotable about an axis of inclination extending parallel to the parking-place-side pivotal axis.

In a first preferred embodiment, it is provided that the drive for pivoting the guide of the lift is constituted by the lift and the control device for pivoting the guide of the lift raises or lowers the lift.

In an alternative form of development, it may be provided that the drive for pivoting the guide of the lift is formed by a lifting device disposed on the lift and that the control device for pivoting the guide of the lift raises or lowers the lifting device.

It is particularly advantageous if by means of the control device the guide of the lift prior to its being set down on the supporting surface of a parking place is pivoted relative to the lift down towards the parking place about an axis of inclination extending parallel to the parking-place-side pivotal axis and after being set down is pivoted into the horizontal position.

It may further be provided that the guide on the lift is displaceable in horizontal direction by a displacement device parallel to the displacement direction of the guide and that the control device activates the displacement device in such a way that the guide of the lift for setting down onto a supporting surface of a parking place to be approached is displaced out of a lifting position, in which the guide during the travel of the lift between various parking places is positioned in such a way that it is spaced apart from the supporting surfaces of the parking places, into a set-down position, in which the ends of the guide of the lift are situated above the supporting surface of the parking place to be approached.

In particular, a gearing mechanism may be provided, which upon the horizontal displacement of the guide of the lift out of the lifting position into the set-down position pivot the guide of the lift simultaneously about the axis of inclination in such a way that the end of the guide facing the parking place to be approached is lowered relative to the opposite end.

The gearing mechanism may comprise for example a track for the horizontal displacement of the guide of the lift that dips at the end facing the parking place to be approached and/or rises at the end remote from the parking place to be approached.

In a particularly advantageous development, the track may be formed by a cam track and by cams, which during the horizontal displacement of the guide are in contact with said cam track.

The cam may be moved away in an upward direction off the cam track so that in this way a horizontal position of the guide on the lift is achievable.

It is advantageous if cam track and cam are disposed at two support points disposed with mutual spacing in longitudinal direction of the guide. In this way a lifting of the cam off the cam track may be effected at the one or at the other support point, this being advantageous if a symmetrical construction of the parking facility is used and the lift is to connect the guide selectively to a parking place at the one or at the opposite side of the lift.

In a further development, it is provided that the guide is mounted at the centre of its longitudinal extent on the lift so as to be pivotable about the axis of inclination. This results in a very simple construction for the pivotability of the guide of the lift about an axis of inclination.

In another preferred embodiment, it is provided that the axis of inclination is disposed at the side of the lift remote from the parking place to be approached, thereby resulting in a large distance of the axis of inclination from the parking place to be approached and hence in a very slight displacement of the end of the guide on the lift upon pivoting of the guide.

The parking facility may be of a one-sided construction but it is also to be provided that the parking facility is of a symmetrical construction so that parking places of the same construction are disposed at opposite sides of the lift and that the guide, which is of the same construction at its opposite sides, may be aligned selectively with a parking place to be approached at the one or at the opposite side.

In this case, it is particularly advantageous if the guide is mounted on the lift so as to be pivotable about two axes of inclination that are disposed with mutual spacing in longitudinal direction. Thus, the pivoting of the guide on the lift may always be effected about the axis of inclination that is situated at the greater distance from the parking place to be approached, i.e. either the one or the other axis of inclination comes into effect.

In a special development, it may in this case be provided that between the lift and the guide on the lift a connecting rod is disposed, of which one end at the one bearing point is connected pivotably about the one axis of inclination to the lift and at the other bearing point is connected pivotably about the other axis of inclination to the guide. Thus, the guide is connected to the lift in the manner of a swing door and may be pivoted selectively in the one or in the other direction, wherein for each pivotal movement one of the two axes of inclination serves as a pivotal axis.

It may be provided that the guide on the lift is rotatable about a vertical axis.

In a particularly preferred embodiment of the parking facility, it is provided that the guides of the lift, of the parking places and optionally of an entry station, in which a motor vehicle drives onto a pallet, or in an exit station, in which a motor vehicle positioned on a pallet leaves the pallet, comprise in each case two guideways arranged above each other and that the control device, upon each displacement of a pallet in the top guideway between lift and parking place to be approached, on the one hand, or lift and entry- or exit station, on the other hand, displaces a pallet in the bottom guideway in the opposite direction, so that before and after the displacement of the pallets there is always one pallet in the guide of the lift and one pallet in the guide of the approached parking place as well as in the guide of the entry station or exit station.

The control device may in this case be designed in such a way that in the exit station it lowers the pallet from the top guideway into the bottom guideway after the motor vehicle has left the top pallet.

The control device may moreover be designed in such a way that in the entry station it lifts a pallet from the bottom guideway into the top guideway before a motor vehicle drives into the entry station onto a top pallet.

The following description of preferred embodiments of the invention serves in conjunction with the drawings to provide a detailed explanation.

DETAILED DESCRIPTION OF THE INVENTION

Figure 1:
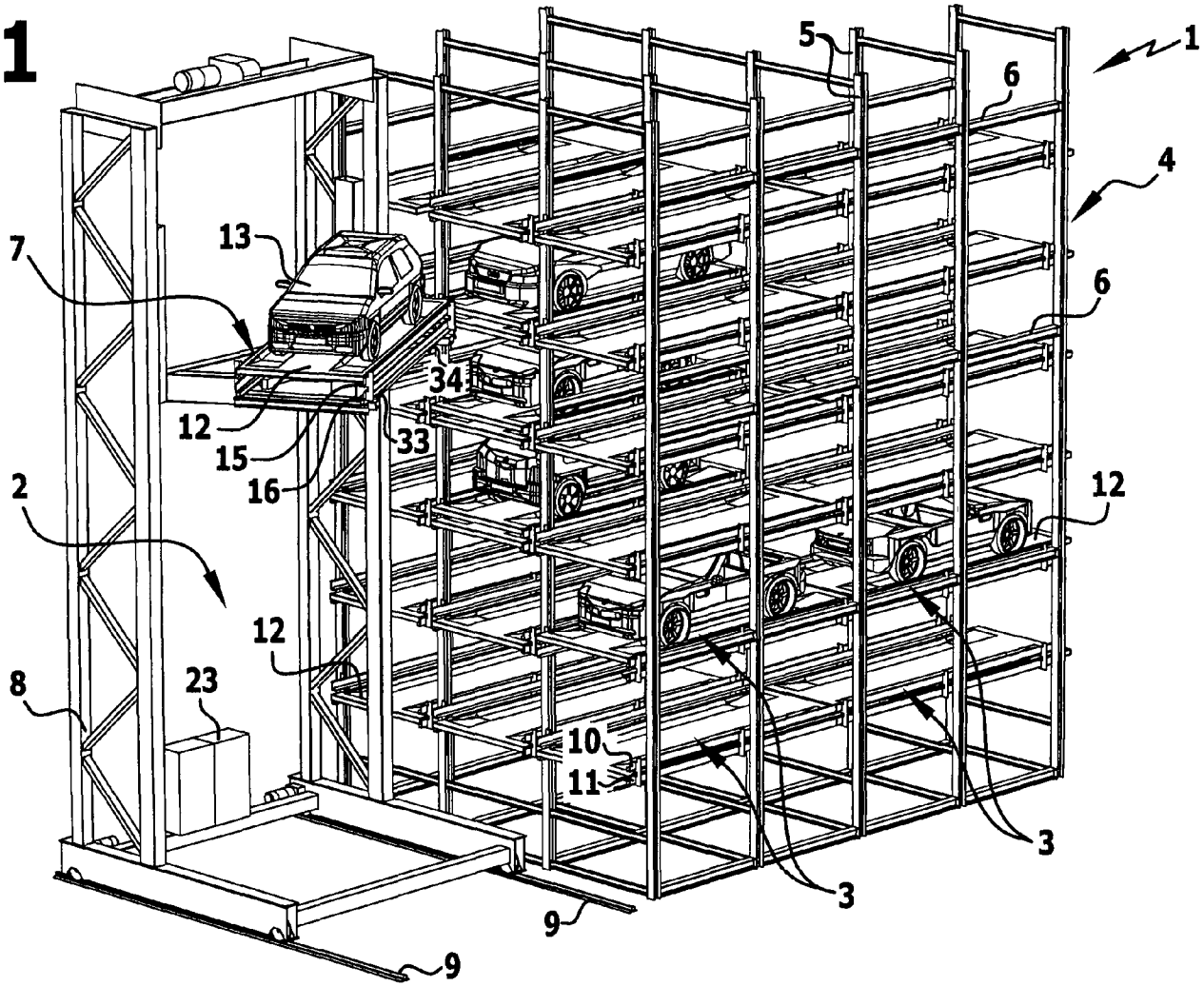
FIG. 1 is a perspective partial view of a parking facility having a lift with a guide that is rotatable about a vertical axis and having parking places disposed above, behind and alongside one another.

The invention is discussed below with reference to a parking facility 1, in which on each side of a lift shaft 2 a plurality of parking places 3 are disposed in a stationary, rack-like manner above and alongside one another, for which purpose a framework 4 of vertical beams 5 and horizontal beams 6 is disposed on both sides of the lift shaft 2, this rack-like framework forming individual bays for the parking places 3.

The lift shaft 2 extends between the two mutually opposite frameworks 4 over the entire width of these frameworks 4, and in this lift shaft 2 over the entire length of the lift shaft 2 a lift 7 is movably accommodated, which is movable over the entire height of the framework 4. In the embodiment represented in FIG. 1, the lift 7 is mounted in a vertically displaceable manner on a gantry 8, which extends over the entire height of the framework 4 and may in turn be moved along rails 9 that extend alongside of the lift shaft 2.

Figure 2:
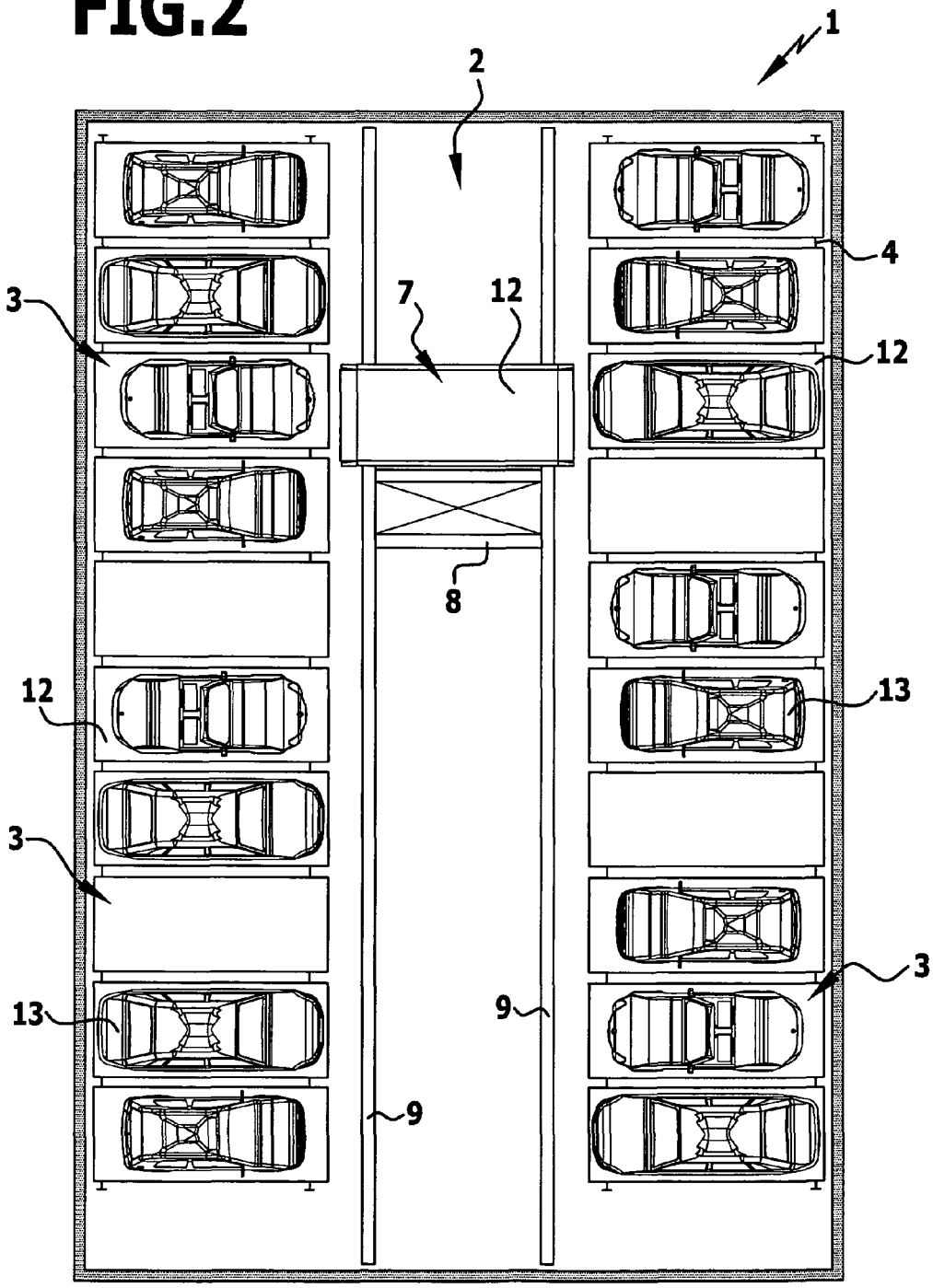
FIG. 2 is a plan view of a parking facility similar to FIG. 1 having parking places on-opposite sides of a lift shaft.
Figure 3:
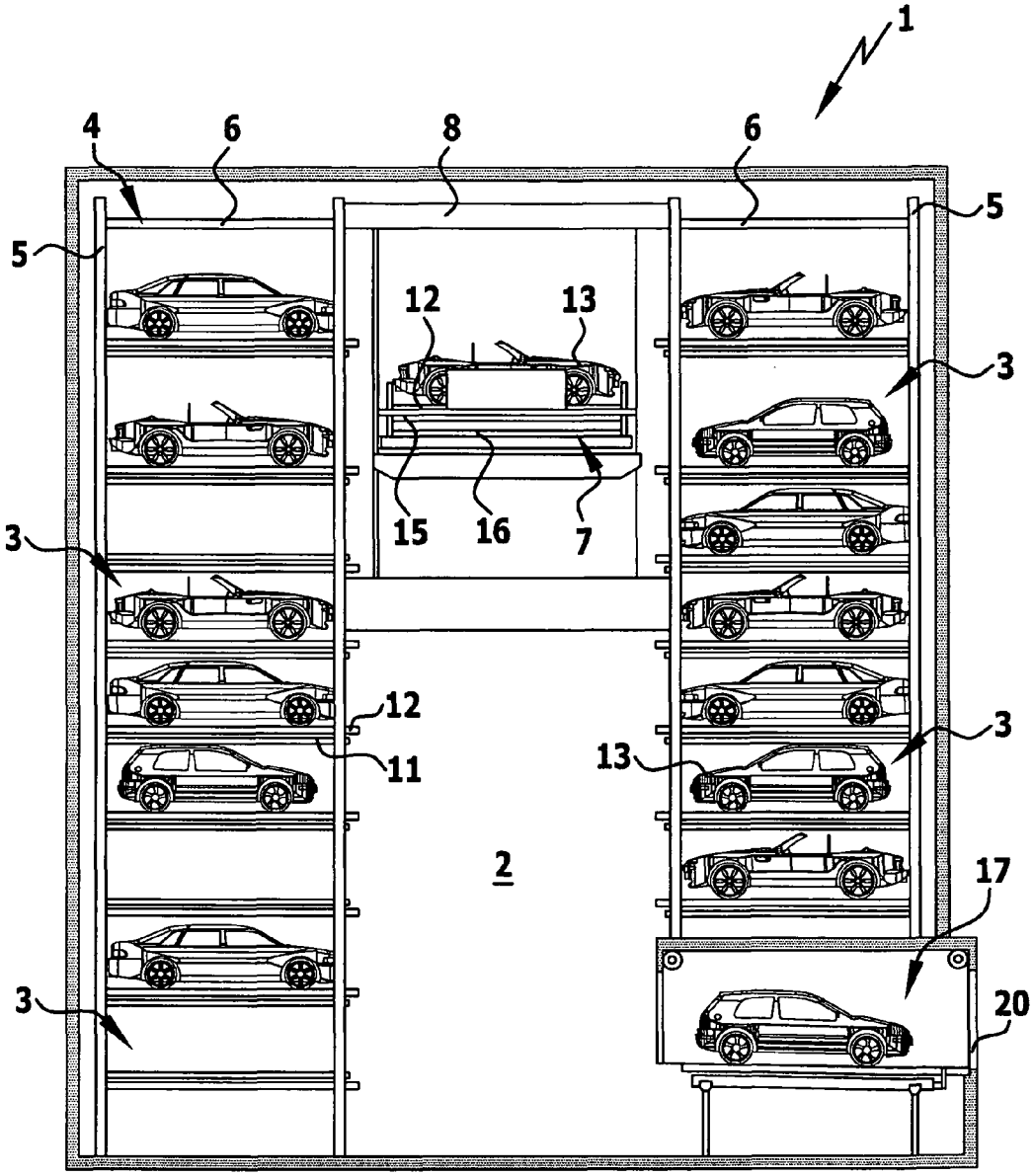
FIG. 3 is a side view of the parking facility of FIG. 2.

In the embodiment illustrated in FIG. 1, the framework 4 accommodates in each case two parking places 3 disposed one behind the other, i.e. has a depth corresponding to twice the parking place length. In the embodiments of FIGS. 2 and 3, on the other hand, in the mutually opposite frameworks 4 on either side of the lift shaft 2 in each case only one parking place is provided, these frameworks 4 therefore having a smaller depth than in the embodiment of FIG. 1.

The lift 7 may alternatively be designed in any other desired manner, for example it may be suspended from cables, the essential point being merely that the lift may be moved over the entire length of the lift shaft 2 and over the entire height of the frameworks 4. In addition, it may be provided that the lift is mounted rotatably about a vertical axis, as is evident from the illustration of FIG. 1. Consequently, motor vehicles supported on the lift may be rotated and hence introduced in any desired direction of travel into the parking places.

In the parking places 3, at the two opposite sides extending transversely of the longitudinal direction of the lift shaft 2 there are disposed in each case at the bottom end of a parking place 3 two horizontal runners 10, 11, which extend parallel to one another and closely above one another and into which pallets 12 used to receive motor vehicles 13 may be pushed and displaced in longitudinal direction. For this purpose, the pallets 12 at their longitudinal sides have rollers 14 that run in the runners 10, 11.

In the same manner two runners 15, 16 are disposed one above the other on the lift 7 and, like the runners 10, 11 in the parking places 3, are used to receive pallets 12 in a displaceable manner.

Two of the parking places 3 of the framework 4, for example two parking places in the bottom story of the framework 4, are replaced by an entry station and/or exit station. In FIG. 3 such an exit station 17 is diagrammatically represented at the bottom end of the righthand framework 4. An entry station is of a substantially identical construction to an exit station 17. The entry station and the exit station, like the parking places 3 and the lift 7, each have runners 18, 19 situated one above the other, these runners however being accessible from both sides by a motor vehicle, i.e. on the one hand from the direction of the lift 7 and on the other hand from the direction of an entrance or exit 20.

Figure 7:
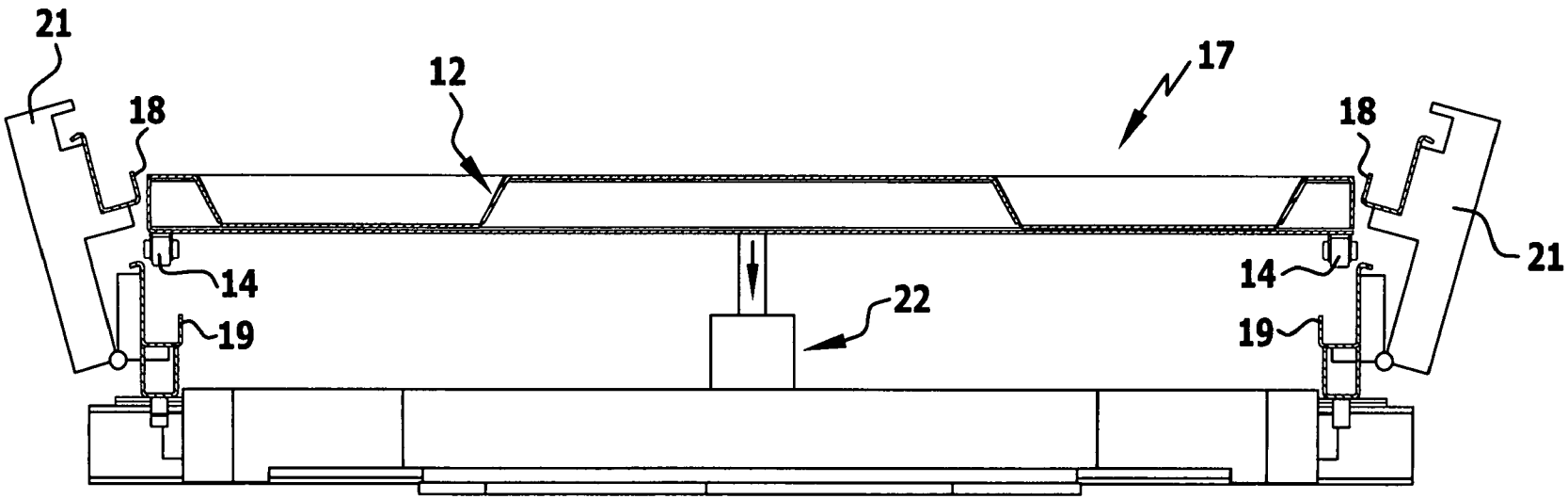
FIG. 7 is a view similar to FIG. 6 with outward-pivoted top tracks.

Whilst the runners 10, 11 of the parking places 3 and 15, 16 of the lift 7 are disposed in a fixed manner, this applies only to the bottom runners 19 of the entry station and the exit station, while the top runners 18 are supported on a beam 21, which is mounted on the entry station and/or exit station so as to be pivotable outwards about a bottom pivot point so that the top runners 18 may be pivoted out laterally, as is illustrated in FIG. 7. Both in the entry station and in the exit station a lifting device 22 is disposed, which acts upon the underside of a pallet 12 that is mounted in one of the runners 18 or 19.

Figure 6:
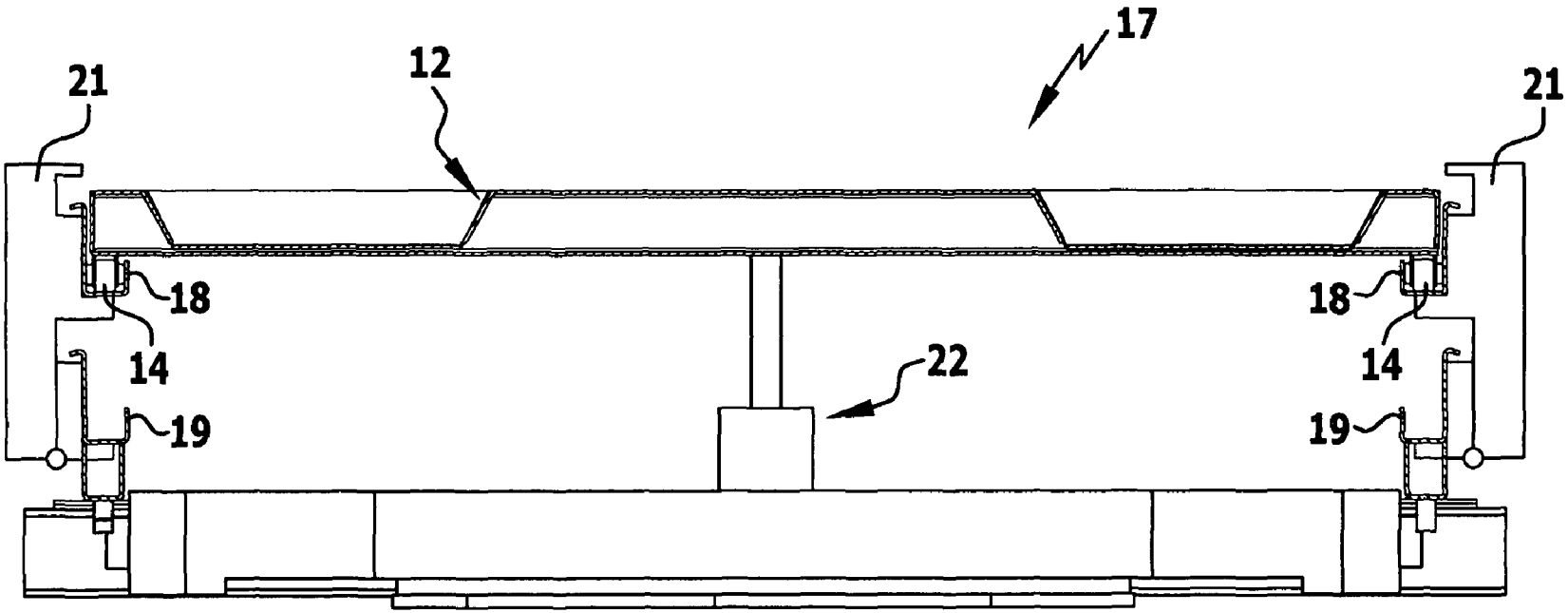
FIG. 6 is a diagrammatic front view of an entry- or exit station having two tracks for pallets arranged above each other, with one pallet in the top track.

This lifting device 22 may raise and lower the pallet 12 and in this case may be for example a hydraulic lifting device that acts with a plurality of pressure cylinders upon various points of a pallet 12 in order to raise and lower this pallet uniformly and parallel to itself. It is therefore possible to lift the pallets up out of the bottom runner 19 when the beam 21 with the top runners 18 is pivoted laterally outwards because in this way the space above the bottom runners 19 is cleared. The pallet 12 in this case may be raised far enough to allow the beam 21 having the top runners 18 to be pivoted back in underneath the pallet, so that when the pallet is subsequently lowered it may be received in the top runners 18 and mounted there in a displaceable manner. In this way it is possible to change the position of the pallet 12 between the top runners 18 and the bottom runners 19 both in the entry station and in the exit station. In FIG. 6 a pallet is illustrated in the top runners 18, the beams 21 in this case being pivoted in. In FIG. 7 the beams 21 are pivoted out and the pallet 12 is lowered by the lifting device 22 into the bottom runners 19. Naturally this operation may be reversed.

During normal operation, before motor vehicles are placed into the parking facility 1, the entry station, the exit station, the lift and all of the parking places are equipped in each case with a pallet 12. The pallets are situated in the parking places in each case in the bottom runners 11, this applying equally to the lift 7 and to the exit station, whereas in the entry station the pallet 12 is situated in the top runner 18.

A control device 23 is provided, which by means of suitable drives controls the movements of the lift 7, the displacement of the pallets 12 along the runners as well as the raising and lowering of the pallets by means of the lifting device 22, so that the entire garaging operation of a motor vehicle is automatically controlled by this control device 23.

For garaging a motor vehicle 13, it is driven into the entry station onto the pallet 12 of the entry station that is mounted there in the top runner 18. Once the motor vehicle has been driven fully into the entry station and the user has left the entry station, the entry station is closed at the entry side and the control device displaces the pallet 12 with the motor vehicle 13 positioned thereon into the lift 7 aligned with the entry station, the pallet there being pushed into the unoccupied top runner 15 of the lift 7. At the same time, the pallet 12 in the bottom runner 16 of the lift is pushed into the entry station, namely into the bottom runner 19 thereof. Thus, in this way the pallets of the entry station and the lift change their position simultaneously so that after this operation there is in each case only one pallet in the entry station and in the lift, namely the pallet loaded with the motor vehicle 13 in the lift and an empty pallet in the bottom runner 19 in the entry station. By means of the lifting device 22 this bottom pallet 12 is relocated into the top runner 18 in the entry station, with the result that the entry station is ready to receive the next motor vehicle.

Through displacement of the gantry 8 and by means of a corresponding lifting movement the lift travels to the parking place 3, in which the motor vehicle is to be parked. After alignment of the lift with the corresponding parking place, the pallet loaded with the motor vehicle is pushed into the top runners 19 of this parking place, and at the same time the pallet 12 disposed in the bottom runner 11 of this parking place is pushed into the bottom runner 16 of the lift so that, in this case too, a simultaneous exchange of the positions of the pallets occurs, with the result that after this exchange there is once more in each case only one pallet disposed both in the parking place and in the lift, namely the pallet loaded with the motor vehicle in the parking place and the empty pallet in the lift, namely in the bottom runner 16.

Figure 4:
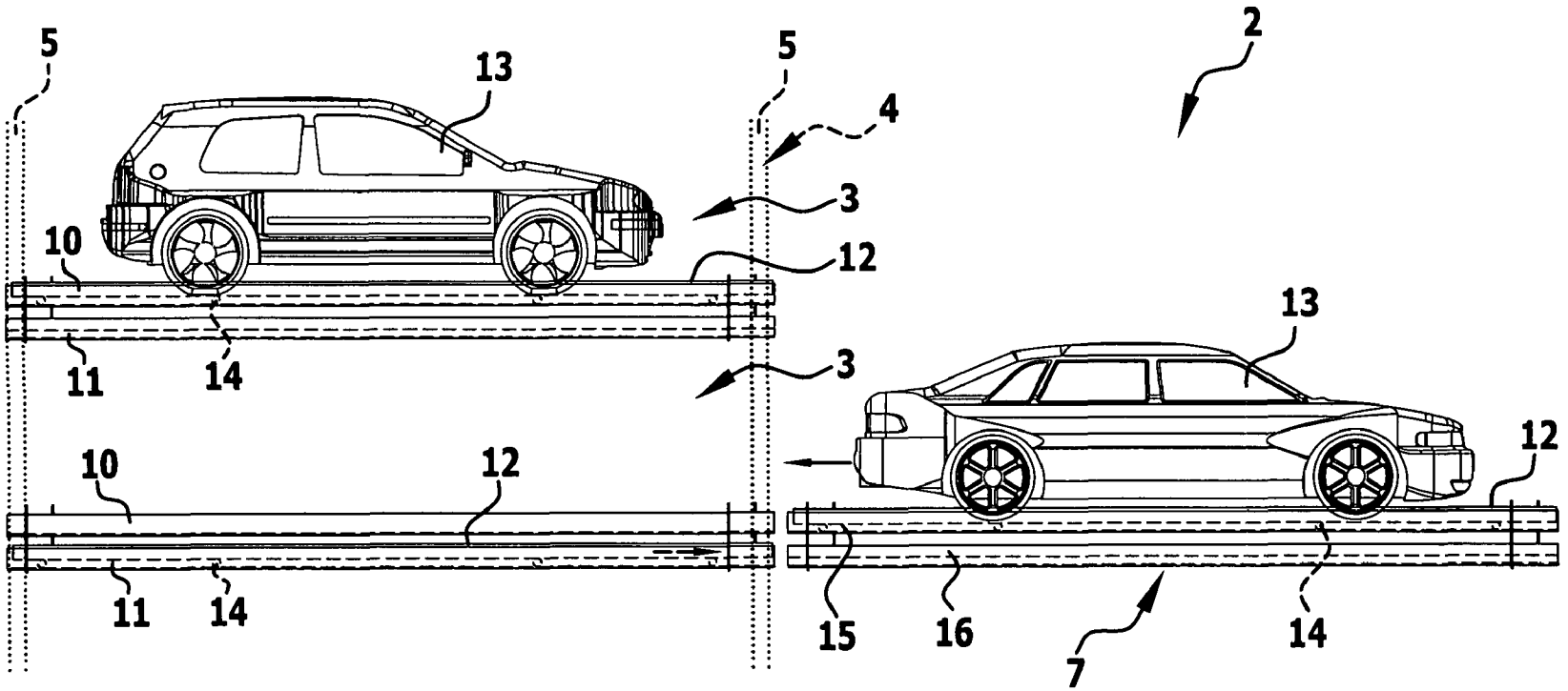
FIG. 4 is a diagrammatic side view of a lift in alignment with a parking place during the transfer of a pallet loaded with a motor vehicle to the parking place and the transfer of an empty pallet to the lift.
Figure 5:
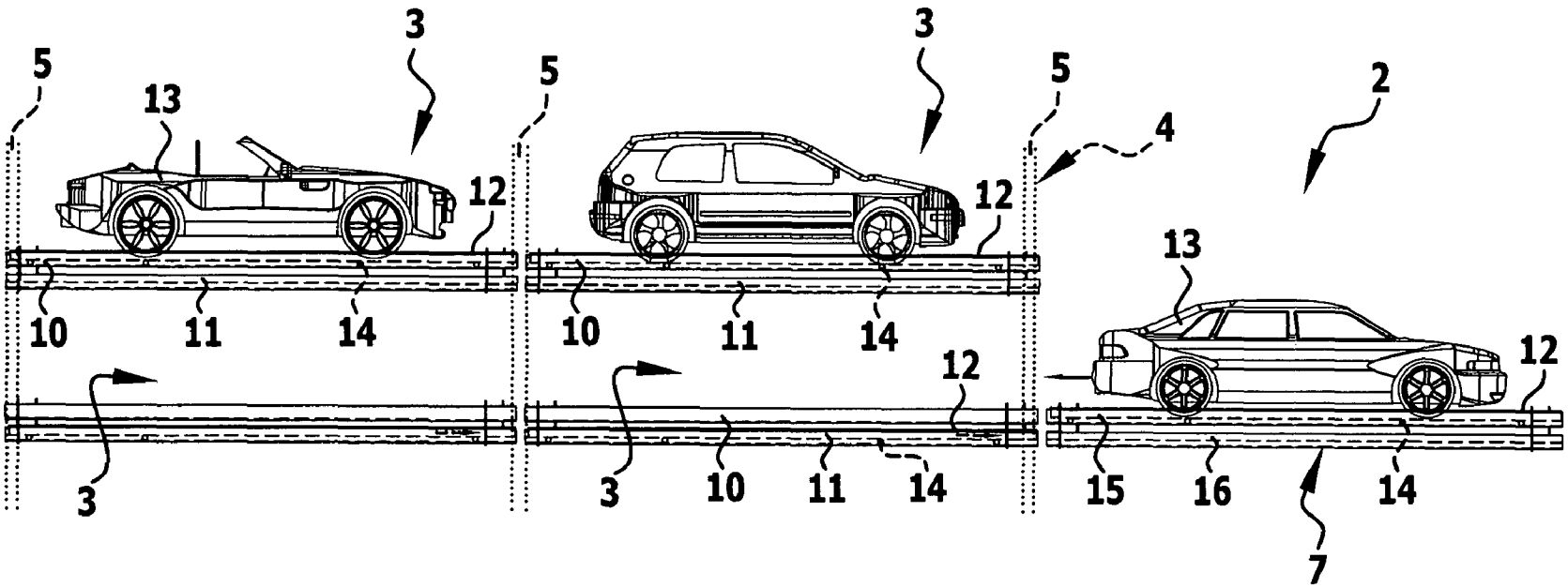
FIG. 5 is a view similar to FIG. 4 with two parking places disposed one behind the other.

FIG. 4 shows the movement of a pallet 12 occupied by a motor vehicle 13 into a parking place 3, with simultaneous transfer of an empty pallet from the parking place 3 onto the lift 7. In the arrangement of FIG. 4 the framework 4 has a depth corresponding to only one parking place, whereas in the embodiment of FIG. 5 the framework is twice as deep, so that two parking places are disposed one behind the other. FIG. 5 shows the same exchange operation for this situation.

If, as illustrated in FIG. 1, the framework 4 has two parking places 3 disposed one behind the other, the loaded pallet may remain directly next to the lift shaft 2 or may alternatively be pushed right to the back, equally the one bottom pallet associated with these two parking places may then remain either below the back or the front parking place. The essential point is merely that for each parking place in the framework that is not occupied by a motor vehicle there is a pallet in the bottom runners of the corresponding parking place.

In the exit station an operation that is the reverse of that of the entry station occurs. For exit purposes, the lift brings a pallet 12 loaded with a motor vehicle 13 into alignment with the exit station, in which an unoccupied pallet rests in the bottom runner 19, so that the lift may displace the pallet with the motor vehicle into the top runner 18. As soon as this has been done, the motor vehicle may leave the exit station through the exit 20. The lifting device 22 then lowers the empty pallet 12 into the bottom runner 19 so that the top runner is available to receive the next occupied pallet.

For the alignment of the lift 7 with the parking places 3 special measures are taken to ensure that the runners 15, 16 of the lift 7 are precisely aligned with the runners 10, 11 of the parking places 3 and extend precisely horizontally for the transfer of the pallets 12.

For the movement of the lift 7 in the lift shaft 2 and for the lifting and lowering of the lift it is necessary to leave a gap between the parking places 3, on the one hand, and the lift 7, on the other hand, in order to allow the lift 7 to be moved without difficulty past the parking places. This gap may turn out to be relatively large, particularly if the lift 7 is additionally rotatable about a vertical axis because then there is an additional spatial requirement for the rotational movement. For the transfer of the pallets from the lift to a parking place and vice versa, on the other hand, the runners of the lift and of the parking place should immediately adjoin one another in order that these runners of the lift and of the parking place jointly form a track for the pallets that is as free of interruptions and continuous as possible.

In order to achieve this, the two runners 15, 16 of the lift 7, which are referred to hereinafter by the collective term "guide", are disposed on the lift 7 so as to be displaceable in horizontal direction. For this purpose, for example the lift 7 may carry a drive that displaces the guide horizontally relative to the lift, namely selectively in the one direction and in the opposite direction, depending on the parking place, to which the guide is to be connected.

Whilst this does achieve a connection to the parking places in horizontal direction, it does not ensure that the runners of the guide are connected up to the runners of the parking place.

In order additionally to achieve this, the individual parking places 3 at their end facing the lift shaft 2 carry supporting surfaces 24 that project into the lift shaft 2 and for example take the form of projections disposed on the underside of the two runners 15, 16, as is evident from FIGS. 8 to 17. The runners 15, 16 of the lift 7 are also equipped at their underside with such projections 25, the supporting surfaces 24 and the projections 25 in this case being disposed in such a way that, upon lowering of the lift 7 and hence of the runners 15, 16 of the guide, the projections 25 of the runners 15, 16 are set down onto the supporting surfaces 24 of the parking places 3 once the guide on the lift has been pushed laterally close up to one of the two frameworks 4.

Figure 8:
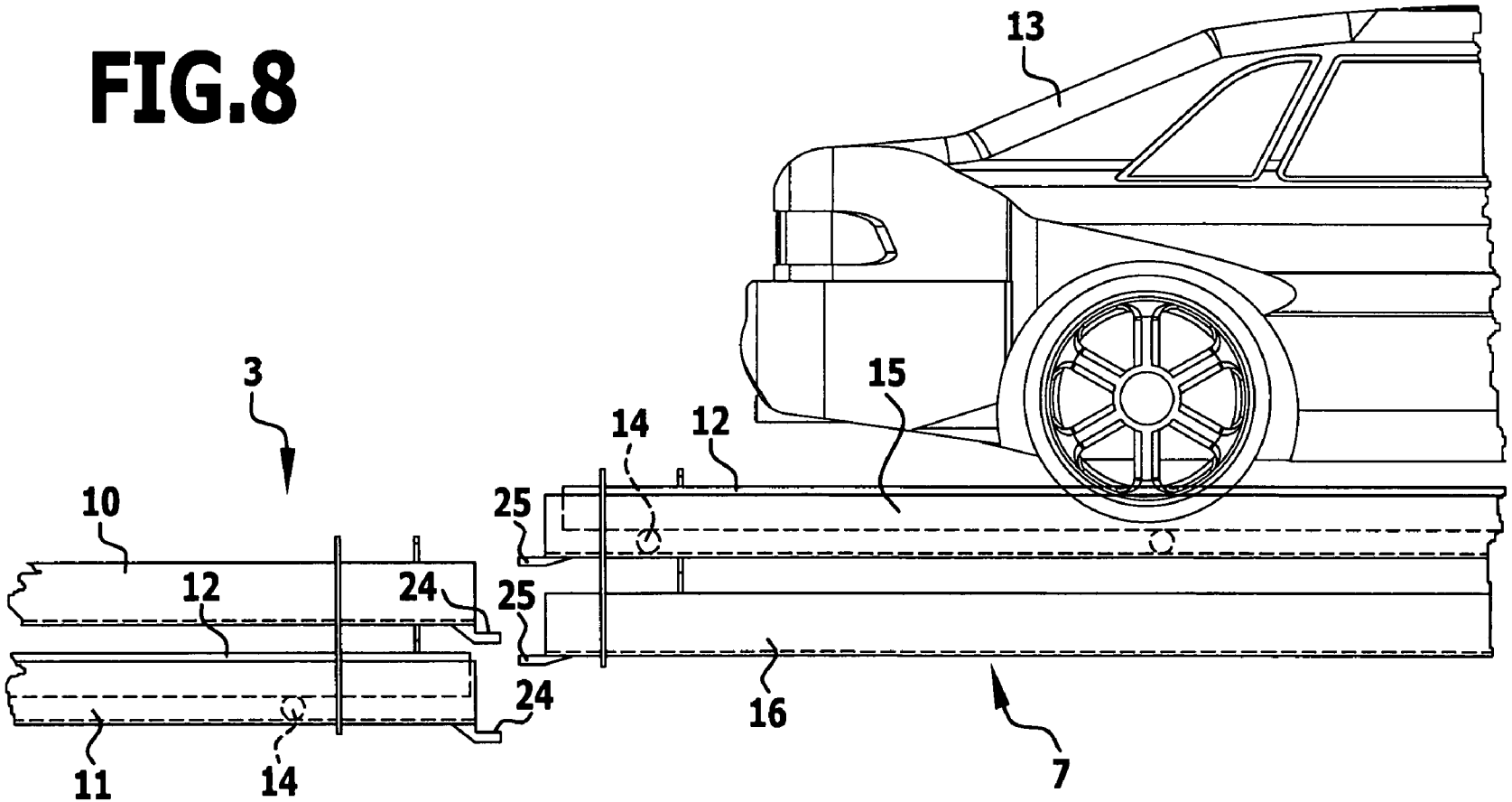
FIG. 8 is a detail side view of the lift during travel past a parking place.

FIG. 8 illustrates the situation where the guide on the lift 7 has been moved away from the framework to allow the lift to move without difficulty past the framework 4.

Figure 9:
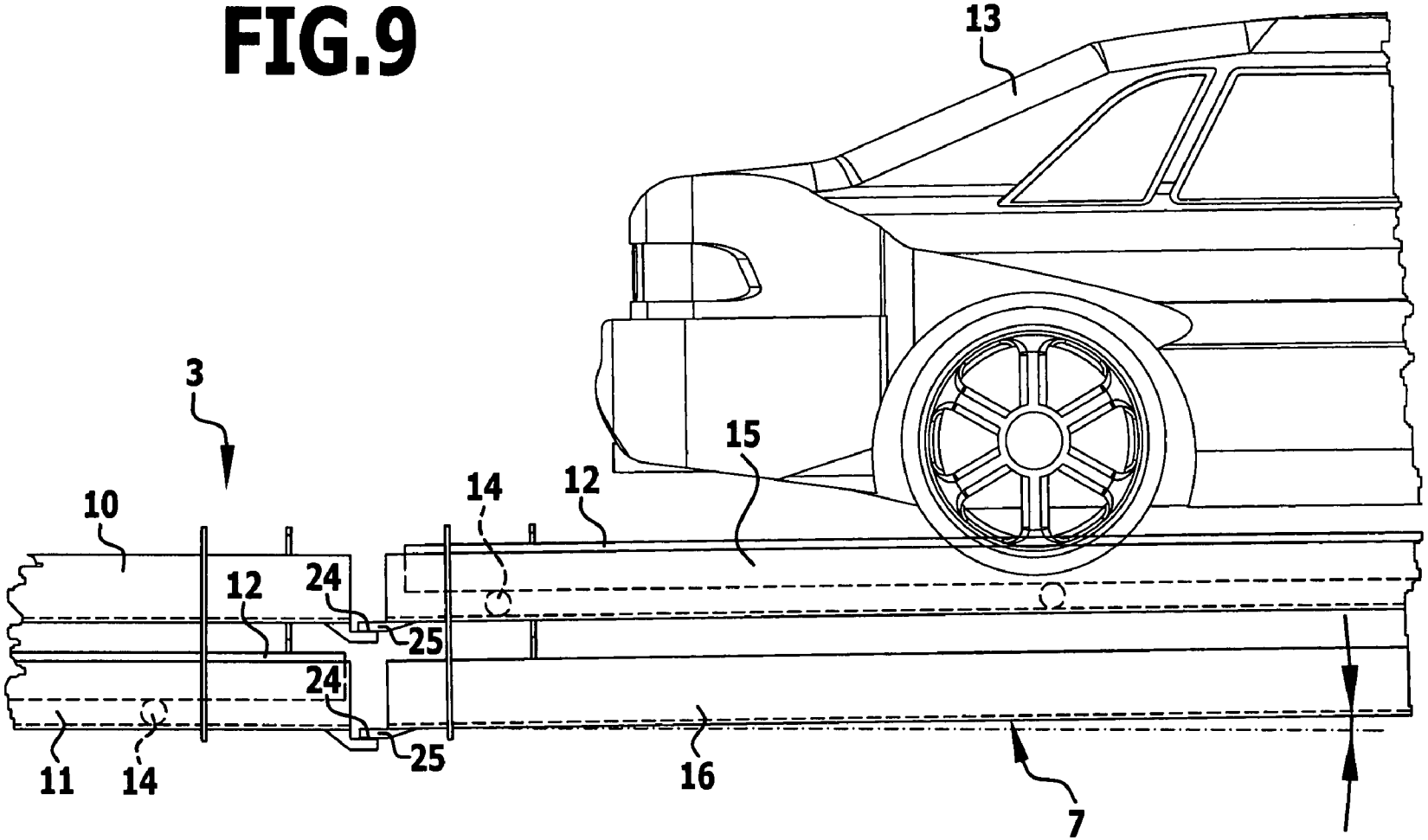
FIG. 9 is a view similar to FIG. 8 during the approach of the lift to a parking place, with the guide of the lift lowered in the direction of the parking place and with the guide set down onto a supporting surface of the parking place.

FIG. 9, on the other hand, illustrates the situation where the guide has been moved horizontally up to the framework 4 so that, upon lowering of the lift 7, the projections 25 are set down onto the supporting surfaces 24 and hence in this region the runners 15, 16 of the lift are aligned height-wise with the runners 10, 11 of the parking place 3.

A prerequisite of a correct alignment of the runners 15, 16 of the lift 7 with the runners 10, 11 of the parking place 3 is however moreover that the lift 7 stops in exactly the correct position, in which these runners come to lie precisely with the projection 25 on the supporting surfaces 24. This is achievable in practice only with great difficulty.

Figure 12:
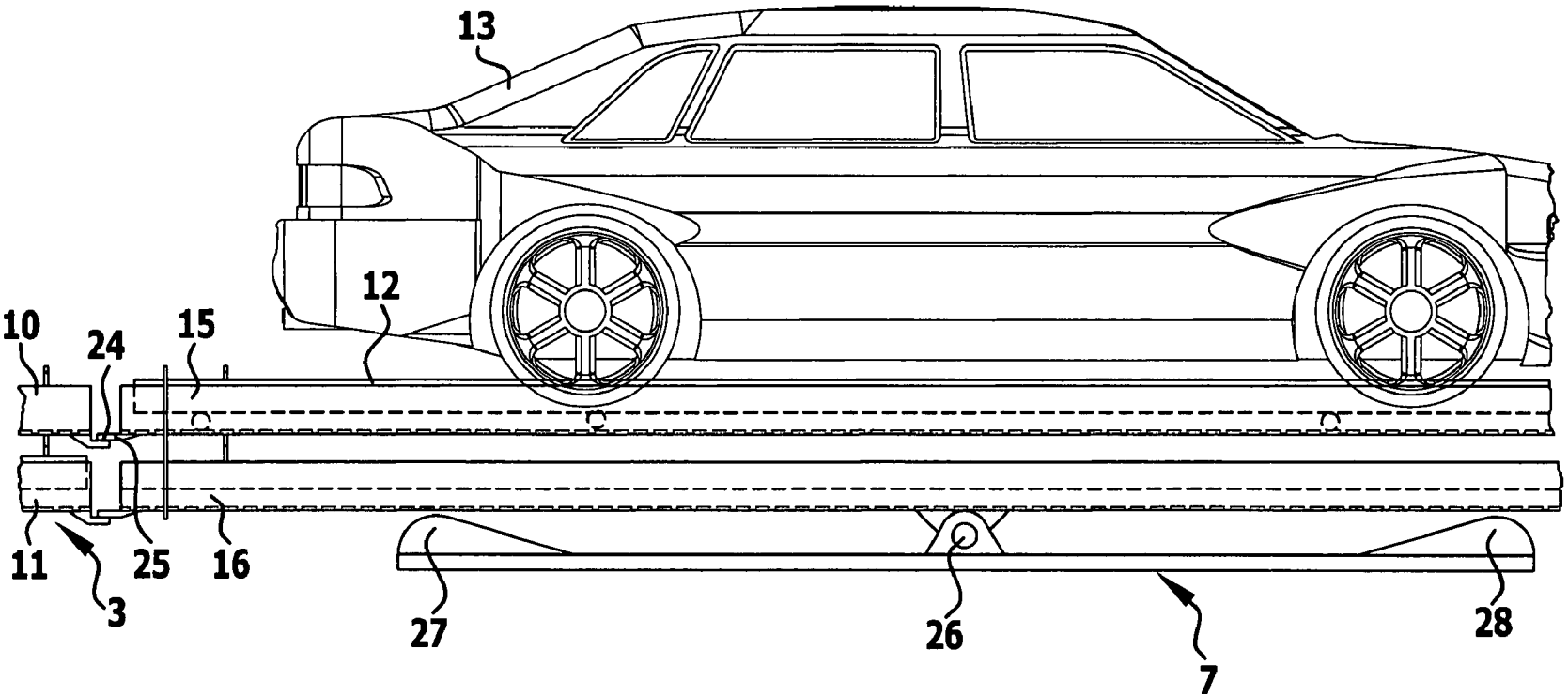
FIG. 12 is a view similar to FIG. 11 with a guide aligned horizontally by height adjustment of the lift.

For this reason, it is further provided that the guide is mounted on the lift 7 so as to be pivotable about a horizontal axis of inclination extending transversely of the longitudinal direction of the runners 15, 16. This mounting may be effected in a simple case by means of a pivot bearing arrangement that is provided in the centre of the longitudinal extent of the runners 15, 16, as illustrated in FIG. 12. There, at a central bearing point the entire guide is mounted pivotably on the lift 7, the pivoting movement being limited by stops 27, 28 so that only relatively small pivot angles are possible.

Given such an arrangement, the lift 7 upon lowering may in any case be lowered far enough for the projections 25 to rest on the supporting surfaces 24. If the lift is then not immediately stopped but additionally lowered a little further, this leads merely to a pivoting of the guide whilst the support of the projections 25 on the supporting surface 24 is maintained. The control device may then carry out a corrective movement of the lift 7 and lift the lift back up a little until the runners 15, 16 of the guide are in an exactly horizontal position. Thus, during the initial approach of a parking place 2 it is not necessary for the lift to be stopped precisely, rather it is sufficient for the lift to stop after the projections 25 have been set down onto the supporting surface 24, the exact horizontal alignment being subsequently achievable by means of a corrective movement.

Given the central mounting of the guide, as represented in FIG. 12, pivotal movements lead to a relatively large displacement of the ends of the runners 15, 16 in horizontal direction because the distance between axis of inclination and the end of the runners is determined only by half the length of the runners. It is therefore more advantageous to provide the axis of inclination at a greater distance from the ends of the runners.

Figure 13:
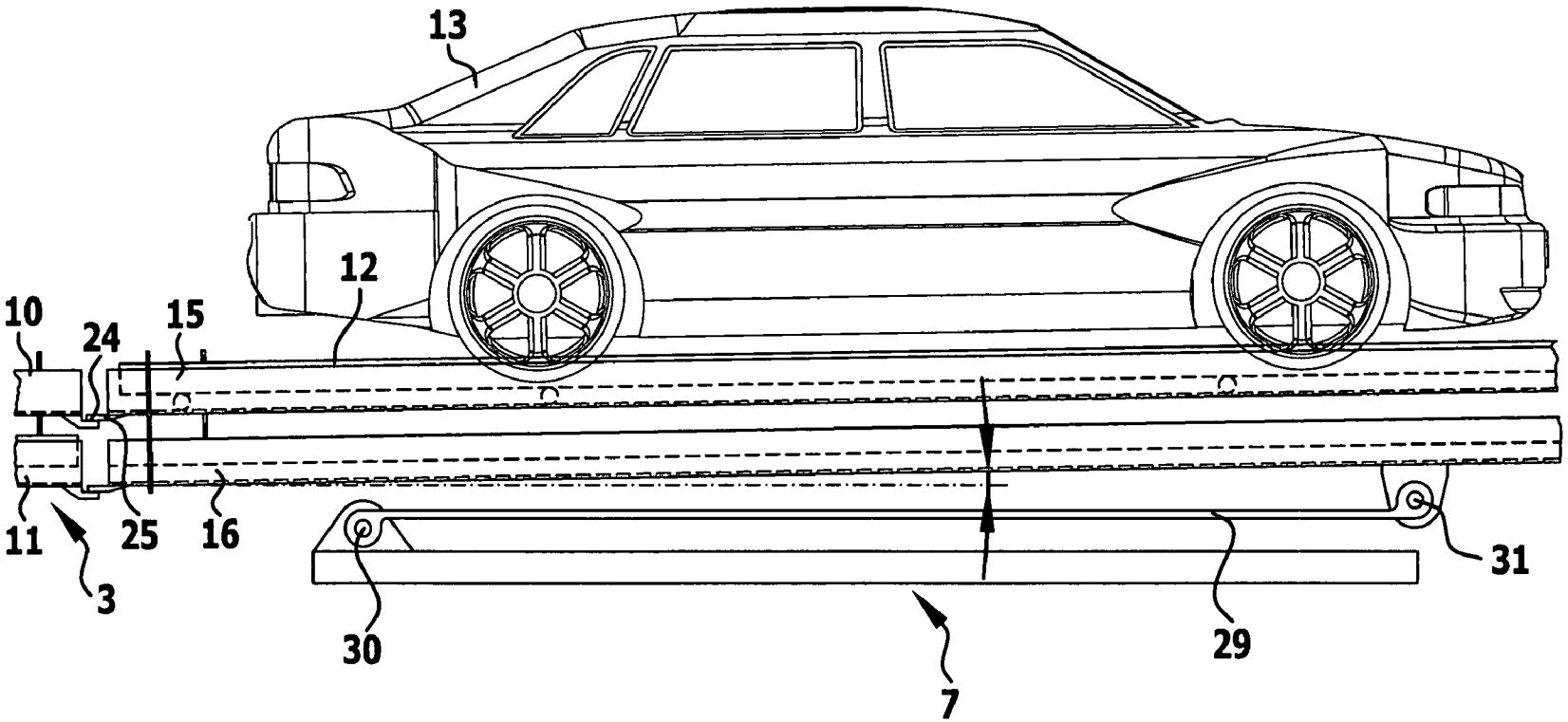
FIG. 13 is a representation of a modified embodiment of a bearing arrangement of a guide on the lift comprising a connecting rod disposed between guide and lift as well as two axes of inclination.
Figure 14:
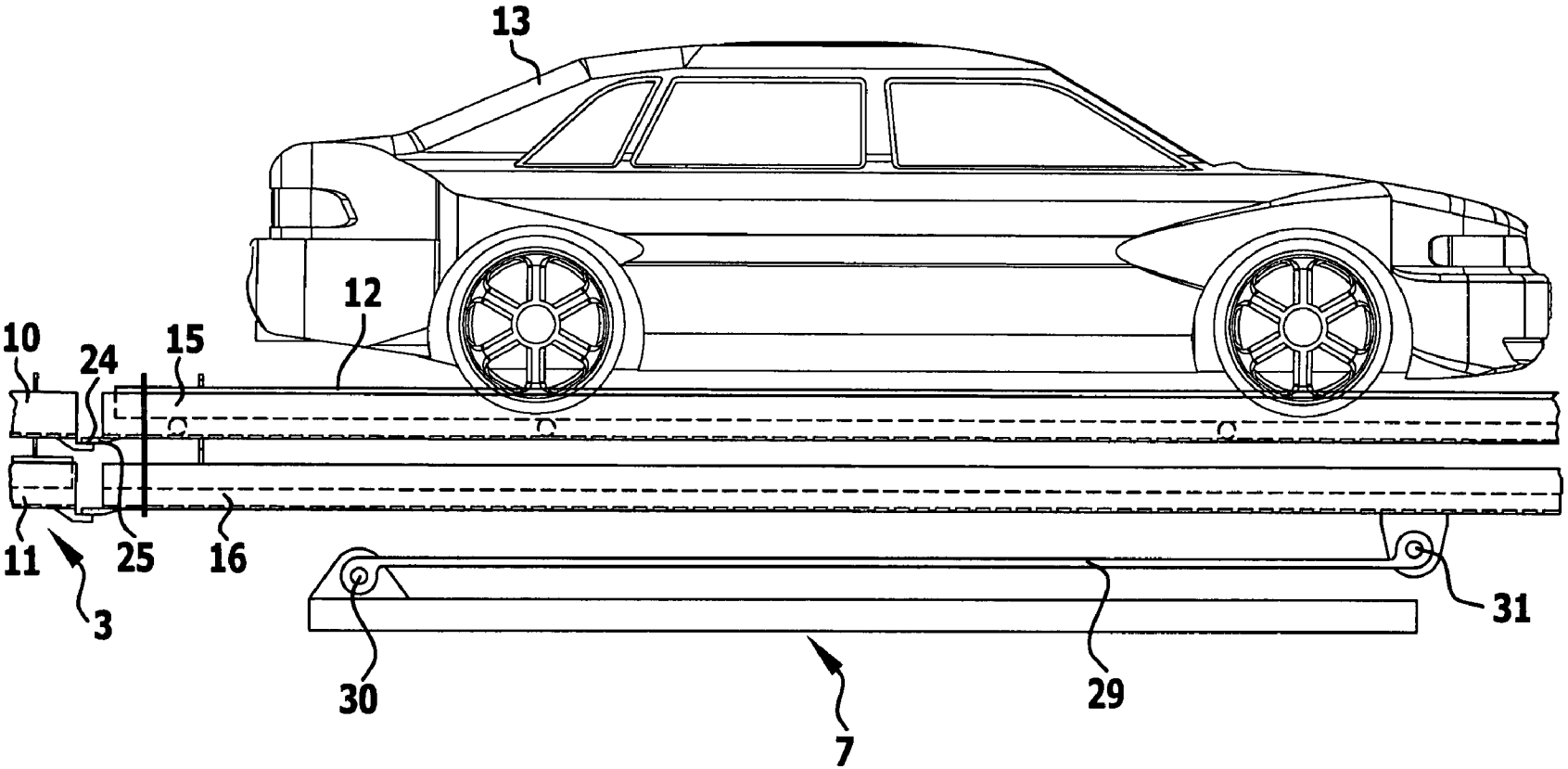
FIG. 14 is a view similar to FIG. 13 with the guide in horizontal alignment.

In the embodiment of FIGS. 13 and 14, for this purpose there is provided on the lift 7 a connecting rod 29, which is mounted by its one end on the lift 7 so as to be pivotable about a first horizontal pivotal axis 30 extending transversely of the longitudinal direction of the runners, while the other end of the connecting rod 29 is mounted pivotally on the guide about a second pivotal axis 31 extending parallel thereto. The two pivotal axes in this case are situated in each case at opposite ends of the lift 7 and hence in the vicinity of the end of the runners 15, 16, with the result that the guide can be pivoted in both directions about axes of inclination, which are almost the entire length of the runners away from the end of the runners 15, 16 set down on the supporting surfaces 24. By means of the connecting rod 29 the guide is mounted in the manner of a swing door on the lift, and as a result a pivotal movement occurs in the one direction about one of the two axes of inclination and in the other direction about the other of the two axes of inclination. During the lowering of the lift and the seating of the projections 25 on a supporting surface 24 the guide is pivoted always about the axis of inclination this is remote from the support point, with the result that the horizontal displacement of the supported runner ends is minimized independently of the side, at which the guide is supported on the supporting surfaces 24 of the respective framework 4.

An alignment of the guide with the runners of the parking places may be achieved also without a reversal of the movement of the lift if the guide, before the projections 25 are set down on the supporting surfaces 24, is inclined in such a way that the guide at the side facing the parking place is lowered relative to the end remote from the parking place. In this case, the projections 25 of a slightly inclined guide encounter the supporting surface 24, and this inclination may be compensated during further lowering of the lift—optionally at a lower speed—by stopping the lift only once the guide is in an exactly horizontal position.

Figure 10:
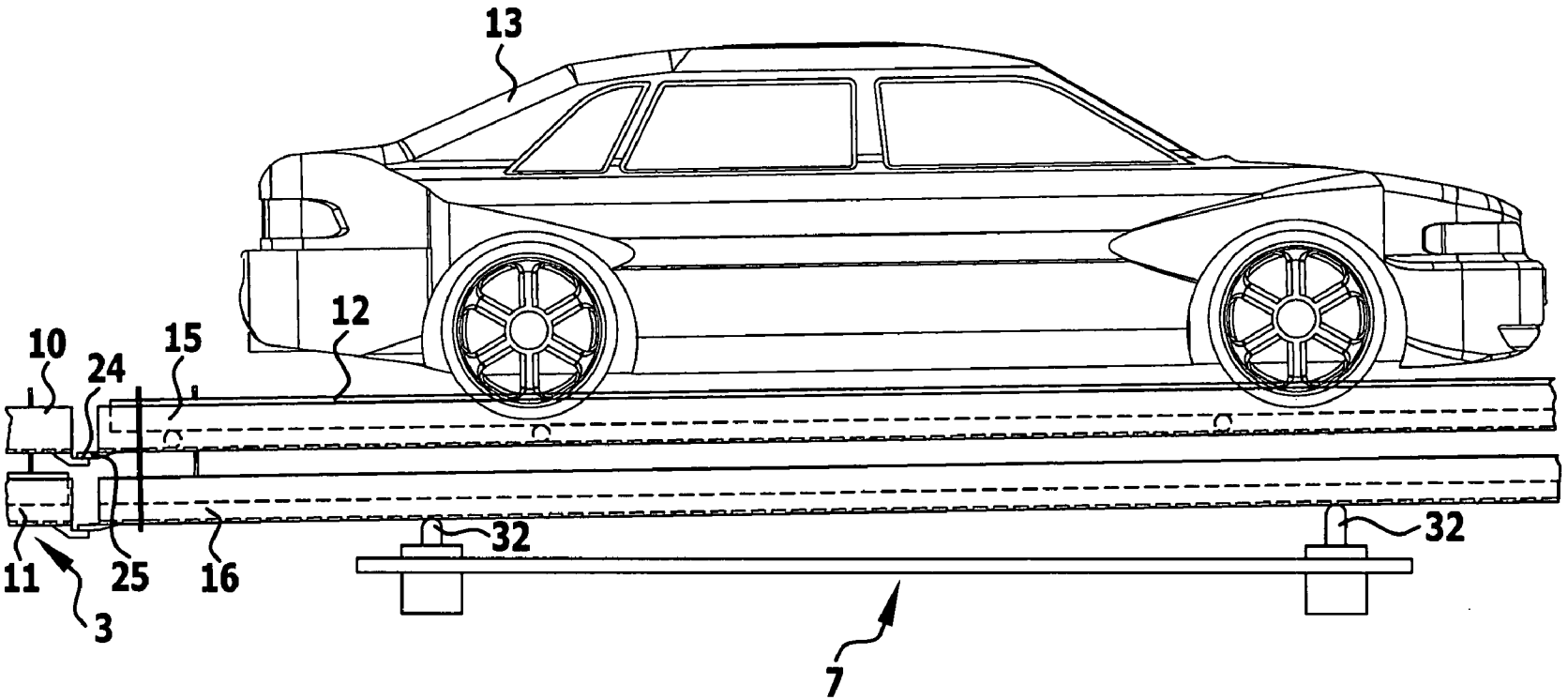
FIG. 10 is a side view of a guide aligned with a parking place and inclined down towards the parking place, with a lifting device for raising and lowering the guide relative to the lift.
Figure 11:
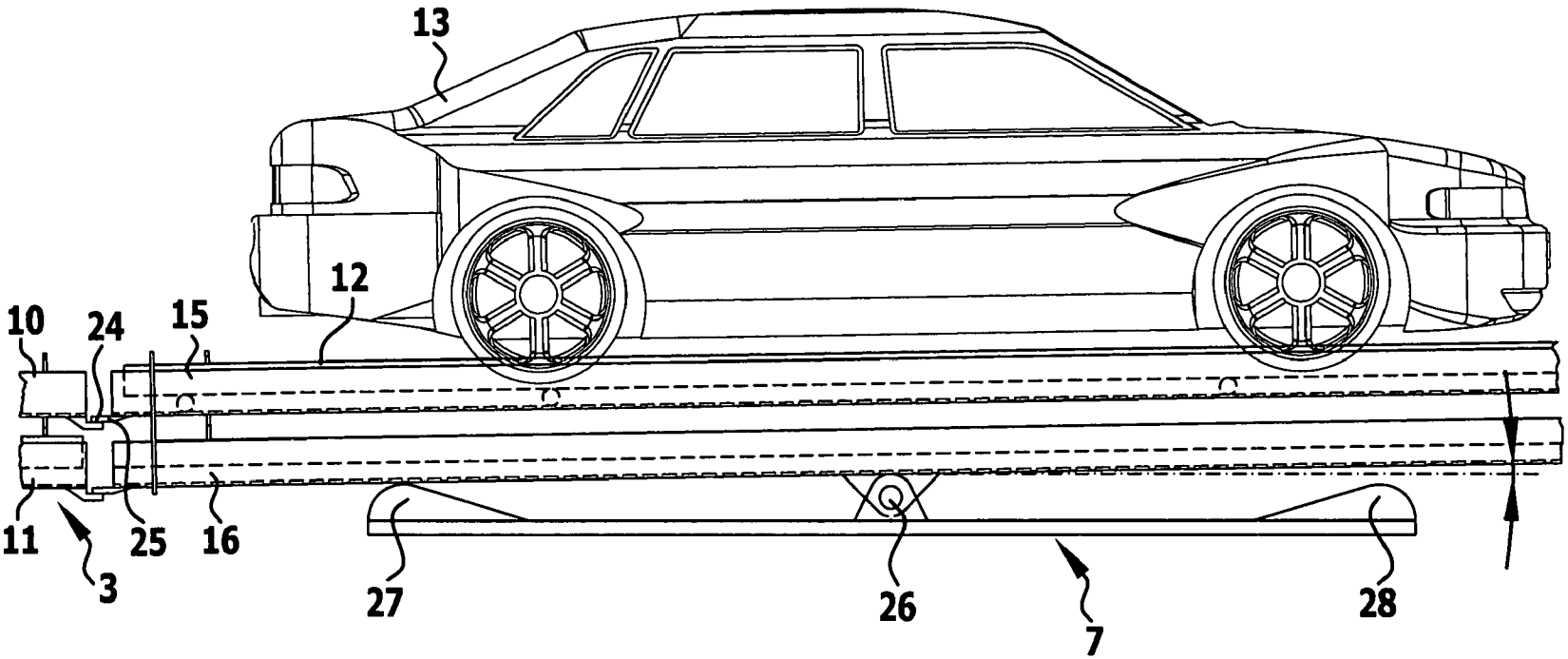
FIG. 11 is a further preferred embodiment of a guide in a similar position to FIG. 10, with a central pivot bearing arrangement of the guide on the lift.

In order to enable this lowering of the guide at the side facing the parking place to be approached, there may be disposed on the lift 7 a suitable lifting device 32, for example a hydraulic piston-cylinder unit, which may pivot the guide about the axis of inclination. A plurality of such lifting devices may also be provided, so that lowering may be effected selectively in the one or the other direction and the axis of inclination is therefore disposed as far as possible from the support point. Such an arrangement is represented in FIG. 10. Such a lifting device 32 might also be used in the embodiments of FIGS. 11 to 14.

Figure 15:
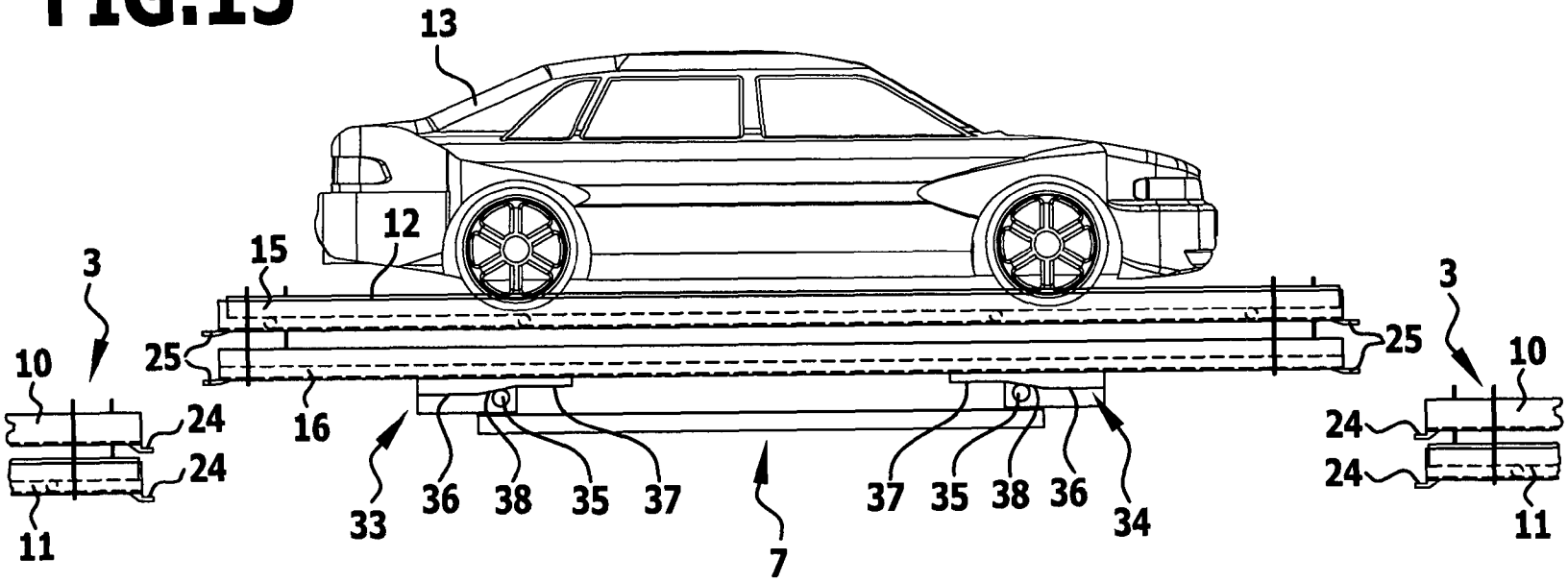
FIG. 15 is a preferred embodiment of a guide, which is mounted by means of two cam tracks on the lift, in the central position on the lift.
Figure 16:
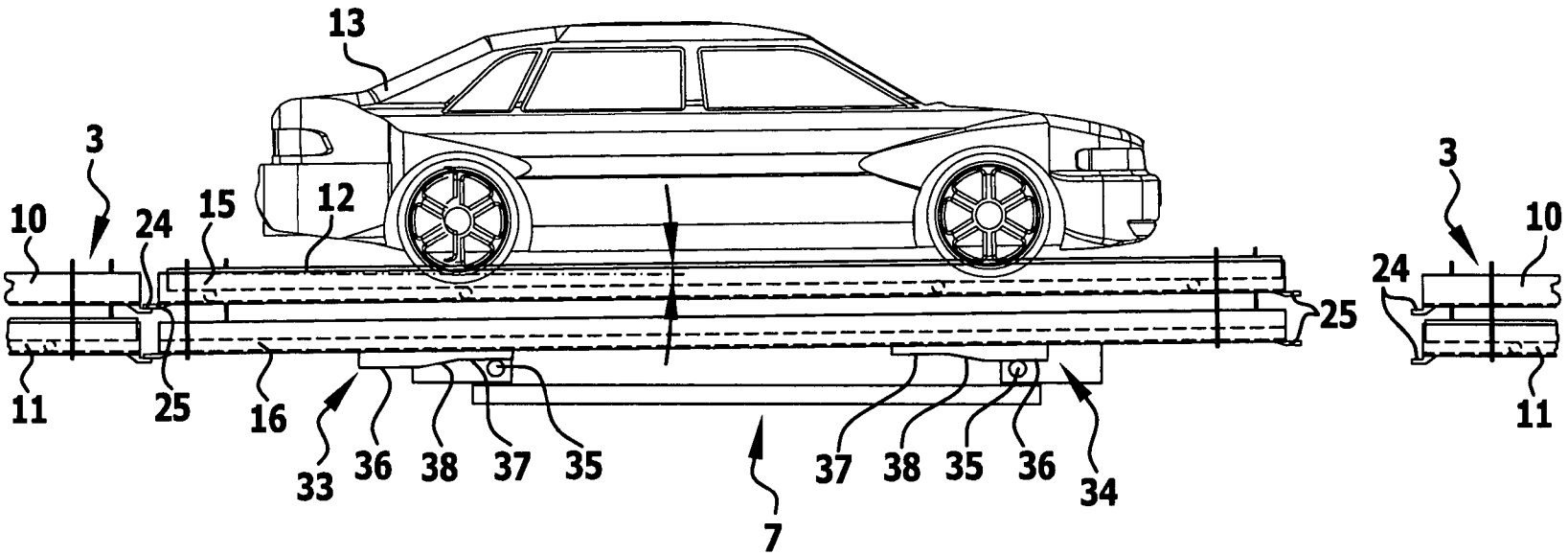
FIG. 16 is a view similar to FIG. 15 with the guide in a position laterally adjoining the parking place to be approached and in an inclined position lowered towards the parking place to be approached and FIG. 17 is a view similar to FIG. 16 with the guide in an aligned horizontal position.
Figure 17:
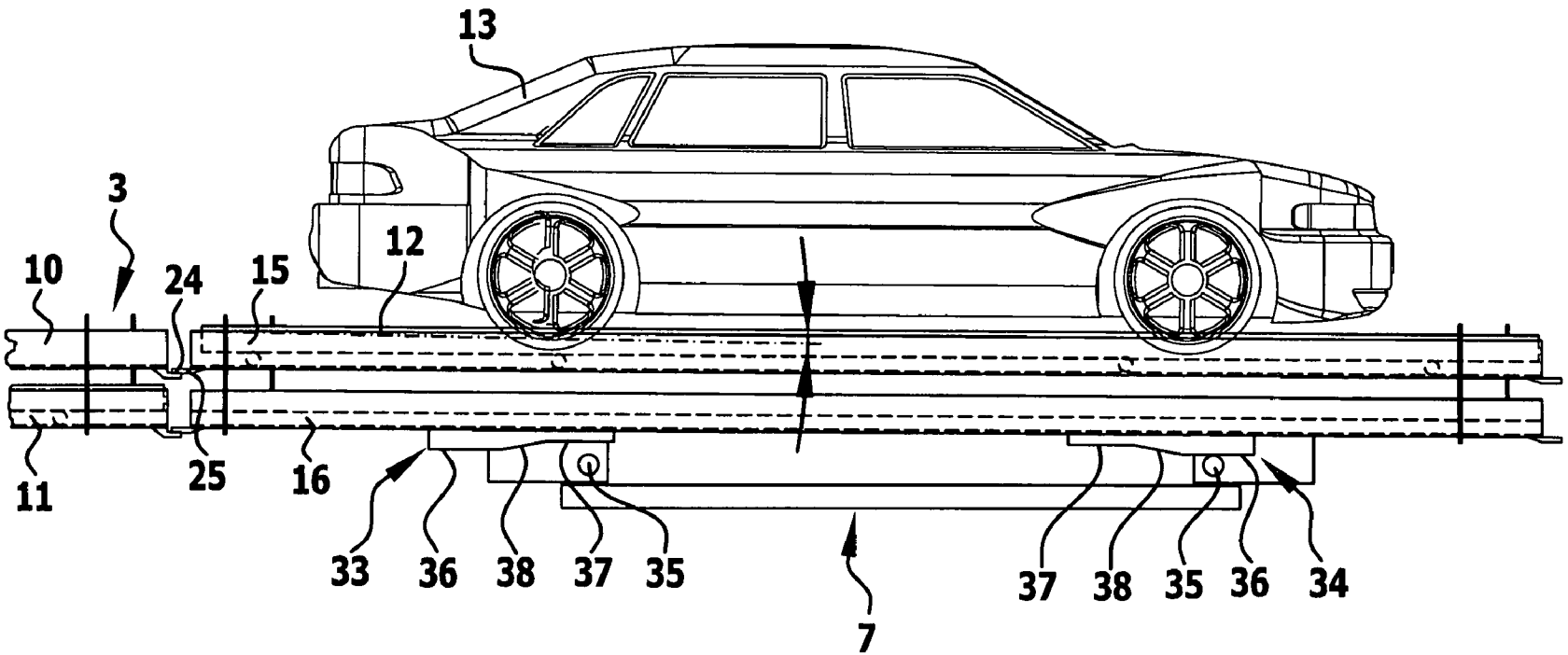

A particularly advantageous development is represented in FIGS. 15 to 17. This utilizes the horizontal movement of the guide that is provided for reducing the distance between the runners 15, 16 of the lift 7, on the one hand, and the runners 10, 11 of the parking place 3 to be approached, on the other hand.

For this purpose, the guide carries lateral cam tracks 33, 34, which are supported on cam rollers 35 mounted on the lift 7. The cam tracks 33, 34 have two end portions, namely in each case an outer end portion 36, which projects further down from the guide than a further, inner end portion 37, which is therefore offset in an upward direction relative to the end portion 36. The two end portions 36, 37 are connected by a rising central portion 38.

The spacing of the cam rollers 35 is selected in such a way that they are positioned at the central portions 38 when the guide is in its central position, i.e. when the guide has approached neither the one nor the other, opposite framework. During the horizontal displacement the cam rollers 35 then move at one side of the guide to the outer end portion 36 and at the other side to the inner end portion 37, thereby lowering the guide at the side, at which it is moved horizontally towards a parking place. This leads to an inclination of the guide that is occasioned without an independent drive solely by the horizontal displacement of the guide.

As soon as the guide rests with its projections 25 on the supporting surfaces 24 of the parking place 3 to be approached, the guide during the further lowering movement of the lift is pivoted about an axis of inclination that is formed by the cam roller 35 remote from the support point. The other cam track is in this case lifted off the corresponding cam roller 35 situated close to the support point, so that consequently during further lowering a horizontal position of the guide may be achieved.

The invention claimed is:

1. A method of operating a parking facility for motor vehicles, the parking facility comprising fixed parking places arranged above each other, each parking place having a first guide for a pallet, the pallet being displaceable along the first guide, and a lift disposed alongside the fixed parking places which carries a second guide for the pallet, the pallet being displaceable in the second guide, the method comprising:

pivoting the second guide of the lift down towards the first guide of a fixed parking space to be approached relative to the lift about an axis of inclination, non-connectedly setting an end of the second guide of the lift facing the fixed parking place down on a supporting surface connected to the fixed parking place, further pivoting the second guide of the lift after the end is set down onto the supporting surface about a horizontal parking-place-side pivotal axis, the pivotal axis extending transversely to a displacement direction of the pallet and being defined by a support point of the end of the second guide of the lift on the supporting surface, until the guide of the lift is in a horizontal position, stopping the lift alongside the fixed parking place such that the second guide of the lift is aligned with the first guide of the fixed parking place, and displacing the pallet between the first guide of the fixed parking place and the second guide of the lift once the first and second guides are in alignment and the second guide is in the horizontal position, wherein the axis of inclination extends parallel to the pivotal axis; and the second guide extends along at least a portion of the pallet when the lift alone holds the pallet.

2. A method according to claim 1, wherein the second guide is pivoted about the parking-place-side pivotal axis in that the second guide of the lift is raised or lowered by means of an upward or downward movement of the lift.

3. A method according to claim 1, wherein the second guide is pivoted about the parking-place-side pivotal axis in that the second guide of the lift is raised or lowered by means of a lifting device disposed on the lift.

4. A method according to claim 1, wherein prior to the setting down of the end of the second guide onto the supporting surface of the fixed parking place to be approached, the second guide is displaced in a displacement direction of the second guide horizontally out of a lifting position, in which the second guide during travel of the lift between various of the parking places is situated in such a way that the second guide is spaced apart from the supporting surfaces of the parking places, into a set-down position, in which the end of the second guide of the lift is situated above the supporting surface of the parking place to be approached.

5. A method according to claim 4, wherein by means of the horizontal displacement of the second guide of the lift out of the lifting position into the set-down position by a suitable gearing mechanism the second guide of the lift is simultaneously pivoted about the axis of inclination in such a way that the end facing the parking place to be approached is lowered relative to an opposite end of the second guide.

6. A method according to claim 5, wherein:

the second guide of the lift during the horizontal displacement is guided along a track, the second guide dips at the end facing the parking place to be approached and/or rises at the opposite end of the second guide remote from the parking place to be approached.

7. A method according to claim 1, wherein the axis of inclination of the second guide of the lift is disposed centrally in a longitudinal direction of the second guide.

8. A method according to claim 1, wherein the axis of inclination of the second guide of the lift is disposed at a side of the second guide of the lift remote from the parking place to be approached.

9. A method according to claim 1, wherein:

parking places of the same construction are disposed at opposite sides of the lift, and second guides of the same construction are provided at opposite sides of the lift, the second guides being aligned selectively with the parking place to be approached at the opposite sides.

10. A method according to claim 1, wherein:

parking places of the same construction are disposed at opposite sides of the lift, and the second guide on the lift is rotated about a vertical axis of rotation in order to align the second guide of the lift with the first guide of the parking place to be approached.

11. A method according to claim 1, wherein:

in the lift and at least one of the parking places, an entry station having a third guide, and an exit station having a fourth guide, the guides comprise a respective pair of guideways arranged above each other, and upon each displacement of one of the pallets between the lift and the approached parking place, the entry station, or the exit station in a top guideway, the pallet in a bottom guideway is displaced in an opposite direction, so that before and after the displacement of the pallets there is always one pallet in the second guide of the lift, one pallet in the approached parking place, one pallet in the entry station, and one pallet in the exit station.

12. A method according to claim 11, wherein in the exit station of the parking facility, which has two guideways for pallets arranged above each other and in which a motor vehicle positioned on one of the pallets leaves said pallet, a top pallet is lowered from the top guideway into the bottom guideway after the motor vehicle has left the top pallet.

13. A method according to claim 11, wherein in the entry station, which has two guideways for pallets arranged above each other and in which a motor vehicle drives onto one of the pallets, the pallet is lifted from the bottom guideway into the top guideway before the motor vehicle drives into the entry station onto a top pallet.

14. A parking facility for motor vehicles, comprising:

fixed parking places arranged above each other, each parking place having a first guide for a pallet that is displaceable along the first guide, and a lift, which is disposed alongside the fixed parking places, the lift having a second guide for the pallet that is displaceable along said second guide, a supporting surface connected to the fixed parking places and onto which an end of the second guide of the lift facing a parking place to be approached can be non-connected set down in order to align the second guide of the lift and the first guide of the parking place to be approached for displacement of the pallet between the first and second guides, and a control device for operating the lift and for displacing the pallets, wherein:

the second guide of the lift after being set down onto the supporting surface forms a horizontal, parking-place-side pivotal axis, which extends transversely to a displacement direction of the pallet and is defined by a support point of the end of the second guide of the lift on the supporting surface, the control device by means of a drive pivots the second guide of the lift, after setting the end down on the supporting surface, about the parking-place-side pivotal axis until the second guide of the lift is in a horizontal position, and by means of the control device, prior to the end being set down on the supporting surface of the parking place, the second guide is pivoted relative to the lift down towards the parking place about an axis of inclination extending parallel to the parking-place-side pivotal axis, and after the end is set down on the supporting surface, the second guide is further pivoted into the horizontal position; wherein the second guide extends along at least a portion of the pallet when the lift alone holds the pallet.

15. A parking facility according to claim 14, wherein the second guide of the lift is mounted on the lift so as to be pivotable about the axis of inclination extending parallel to the parking-place-side pivotal axis.

16. A parking facility according to claim 15, wherein the drive for pivoting the second guide of the lift is constituted by the lift, and the control device for pivoting the second guide of the lift raises or lowers the lift.

17. A parking facility according to claim 15, wherein:

the drive for pivoting the second guide of the lift is formed by a lifting device disposed on the lift, and the control device for pivoting the second guide of the lift actuates the lifting device.

18. A parking facility according to claim 15, wherein the second guide is mounted on the lift at a center of a longitudinal extent of the second guide so as to be pivotable about the axis of inclination.

19. A parking facility according to claim 15, wherein the second guide is mounted on the lift pivotably at a side of the second guide of the lift remote from the parking place to be approached.

20. A parking facility according to claim 14, wherein:

the second guide on the lift is displaceable in a horizontal direction by a displacement device parallel to the displacement direction of the pallet, and the control device activates the displacement device in such a way that the second guide of the lift for setting the end of the second guide down onto the supporting surface of the parking place to be approached is displaced in a displacement direction of the second guide horizontally out of a lifting position, in which the second guide during the travel of the lift between various of the parking places is positioned in such a way that the second guide is spaced apart from the supporting surfaces of the parking places, into a set-down position, in which the end of the second guide of the lift is situated above the supporting surface of the parking place to be approached.

21. A parking facility according to claim 20, wherein a gearing mechanism is provided, which upon the horizontal displacement of the second guide of the lift out of the lifting position into the set-down position, pivots the second guide of the lift simultaneously about the axis of inclination in such a way that the end of the second guide facing the parking place to be approached is lowered relative to an opposite end of the second guide.

22. A parking facility according to claim 21, wherein the gearing mechanism comprise a track for the horizontal displacement of the second guide of the lift that guides the second guide of the lift during the horizontal displacement on said track in such a way that the second guide dips at the end facing the parking place to be approached and/or rises at the opposite end of the second guide remote from the parking place to be approached.

23. A parking facility according to claim 22, wherein the track is formed by a cam track and by cams, which during the horizontal displacement of the second guide are in contact with said cam track.

24. A parking facility according to claim 23, wherein the cam track and the cam are adapted to be moved away from one another.

25. A parking facility according to claim 23, wherein cam tracks and cams are disposed at two support points disposed with mutual spacing in a longitudinal direction of the second guide.

26. A parking facility according to claim 14, wherein:

parking places of the same construction are disposed at opposite sides of the lift, and second guides of the same construction are disposed on opposite sides of the lift, the control device aligns the second guides selectively with a parking place to be approached at the opposite sides.

27. A parking facility according to claim 26, wherein the second guide is mounted on the lift so as to be pivotable about two axes of inclination disposed with mutual spacing in a longitudinal direction.

28. A parking facility according to claim 27, wherein:

between the lift and the second guide there is disposed a connecting rod, one end of the connecting rod at one bearing point is connected pivotably about the one axis of inclination to the lift and at another bearing point is connected pivotably about the other axis of inclination to the second guide.

29. A parking facility according to claim 14, wherein the second guide on the lift is rotatable about a vertical axis.

30. A parking facility according to claim 14, wherein:

the second guide of the lift, and at least one of the first guide of the parking places, a third guide of an entry station, and a fourth guide of an exit station comprise two guideways arranged above each other, and the control device, upon each displacement of one of the pallets between the lift and the approached parking place, the entry station, or the exit station in a top guideway, displaces the pallet in a bottom guideway in an opposite direction, so that before and after the displacement of the pallets there is always one pallet in the second guide of the lift, one pallet in the approached parking place, one pallet in the entry station, and one pallet in the exit station.

31. A parking facility according to claim 30, wherein the control device in the exit station of the parking facility, which comprises two guideways arranged above each other and in which a motor vehicle positioned on one of the pallets leaves said pallet, lowers a top pallet from the top guideway into the bottom guideway after the motor vehicle has left the top pallet.

32. A parking facility according to claim 30, wherein the control device in an entry station of the parking facility, which comprises two guideways arranged above each other and in which a motor vehicle drives onto one of the pallets, raises a pallet from the bottom guideway into the top guideway before the motor vehicle drives into the entry station onto a top pallet.

* * * * *